US010473383B2

(12) United States Patent
Bento et al.

(10) Patent No.: US 10,473,383 B2
(45) Date of Patent: Nov. 12, 2019

(54) REFRIGERATOR SHELF TRANSLATION SYSTEM

(71) Applicant: WHIRLPOOL CORPORATION, Benton Harbor, MI (US)

(72) Inventors: Edson Isaltino Bento, Joinville (BR); Luiz Afranio Alves Ferreira, Joinville (BR); Rafael da Cunha Schmidt, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/039,939

(22) Filed: Jul. 19, 2018

(65) Prior Publication Data

US 2019/0078837 A1 Mar. 14, 2019

(30) Foreign Application Priority Data

Sep. 8, 2017 (BR) ..... 1020170192334

(51) Int. Cl.
*F25D 23/04* (2006.01)
*F25D 23/06* (2006.01)
(Continued)

(52) U.S. Cl.
CPC ..... *F25D 23/04* (2013.01); *F25D 23/067* (2013.01); *A47B 57/06* (2013.01); *A47B 2210/17* (2013.01);
(Continued)

(58) Field of Classification Search
CPC ..... F25D 25/02; F25D 25/022; F25D 25/024; F25D 23/04; F25D 23/067;
(Continued)

(56) References Cited

U.S. PATENT DOCUMENTS 569,640 A * 10/1896 Hartzell ..... A47B 57/567 248/244
774,117 A 11/1904 Tandy
(Continued)

FOREIGN PATENT DOCUMENTS

BR PI0100491 B1 6/2009
BR PI0805999 A2 6/2010
(Continued)

OTHER PUBLICATIONS

BR102015031731A2 Machine Translation, 6 pages (Year: 2017).*
(Continued)

*Primary Examiner* — Andrew M Roersma
(74) *Attorney, Agent, or Firm* — Price Heneveld LLP

(57) ABSTRACT

A refrigerator shelf translation system for a refrigerating appliance includes a movable shelf, a guide structure provided with one or more indentations, and a fixed anchoring component associated with the movable shelf and movably associated with the guide structure. The movable shelf is held in a fixed position relative to the guide structure when there is cooperation between at least one locking span of at least one anchoring component and at least one indentation of the guide structure and, on the other hand, the movable shelf may be shifted vertically relative to the guide structure when distancing from all possible locking spans of all possible anchoring components and their respective indentations of the guide structure.

18 Claims, 3 Drawing Sheets

(51) Int. Cl.
*F25D 25/02* (2006.01)
*A47B 57/06* (2006.01)

(52) U.S. Cl.
CPC ..... *F25D 25/024* (2013.01); *F25D 2325/021* (2013.01)

(58) Field of Classification Search
CPC ..... F25D 2325/00; F25D 2325/021; A47B 57/06; A47B 57/08; A47B 57/10; A47B 57/16; A47B 57/20; A47B 57/567
See application file for complete search history.

(56) References Cited

U.S. PATENT DOCUMENTS 1,952,148 A 3/1934 Stout
1,997,432 A 4/1935 Replogle
2,065,391 A 12/1936 Nance
2,187,916 A 1/1940 Seeger
2,225,762 A 12/1940 Barnsteiner
2,282,342 A 5/1942 Preble
2,412,904 A 12/1946 Money et al.
2,434,117 A 1/1948 Money et al.
2,466,360 A 4/1949 Bitney
2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,741,370 A 4/1956 Dills
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,162,416 A * 12/1964 Amarillas ..... A47B 57/34 248/244
3,266,858 A 8/1966 Klotz
3,295,904 A 1/1967 Cobb
3,410,260 A 11/1968 Morgan
3,610,174 A 10/1971 Kesling
3,682,521 A 8/1972 Kesling
3,866,437 A 2/1975 Spencer
3,984,163 A 10/1976 Boorman, Jr. et al.
4,597,616 A 7/1986 Trubiano
4,638,644 A 1/1987 Gidseg
4,729,613 A 3/1988 Tromble et al.
4,732,435 A 3/1988 Bailey et al.
4,735,470 A 4/1988 Falk
4,834,557 A 5/1989 Dreinhoff
4,914,928 A 4/1990 Fellwock et al.
4,998,382 A 3/1991 Kostos et al.
5,088,801 A 2/1992 Rorke et al.
5,273,354 A 12/1993 Herrman et al.
5,362,145 A 11/1994 Bird et al.
5,411,165 A 5/1995 Ellis
5,415,472 A 5/1995 Brise
5,429,043 A 7/1995 Becker
5,447,146 A 9/1995 Nickerson
5,469,999 A 11/1995 Phirippidis
5,524,981 A 6/1996 Herrmann et al.
5,564,809 A 10/1996 Kane et al.
5,605,344 A 2/1997 Insalaco et al.
5,660,777 A 8/1997 Herrmann et al.
5,673,984 A 10/1997 Insalaco et al.
5,735,589 A 4/1998 Herrmann et al.
5,813,741 A 9/1998 Fish et al.
5,833,336 A 11/1998 Dean
5,918,959 A 7/1999 Lee
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,578,720 B1 6/2003 Wang
6,604,800 B2 8/2003 Hamilton
6,811,045 B1 11/2004 Masker et al.
D505,140 S 5/2005 Reed et al.
D516,100 S 2/2006 Vardon
D516,102 S 2/2006 Vardon
7,021,730 B2 4/2006 Remmers
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D547,640 S 7/2007 Remmers
D551,262 S 9/2007 Becke
7,270,385 B2 9/2007 Mathur et al.
D551,884 S 10/2007 Remmers
7,367,571 B1 5/2008 Nichols
7,467,834 B2 12/2008 Kim et al.
7,497,533 B2 3/2009 Remmers
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,798,339 B2 * 9/2010 Brooks ..... G11B 33/02 211/103
7,878,344 B2 2/2011 Martin et al.
7,976,113 B2 7/2011 Gwak
8,047,397 B2 11/2011 Mittet
D656,970 S 4/2012 Merritt
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,336,976 B2 12/2012 Lee
8,345,326 B2 1/2013 Kitagaki et al.
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,103,582 B2 8/2015 Nash et al.
9,127,878 B2 9/2015 Gossens et al.
9,131,785 B2 9/2015 Peru
9,151,534 B2 10/2015 Lee et al.
D745,581 S 12/2015 Jeon et al.
9,217,601 B2 12/2015 Koo et al.

(56) References Cited

U.S. PATENT DOCUMENTS

| | | | | |
|---|---|---|---|---|
| D747,369 | S | 1/2016 | McConnell et al. | |
| D747,370 | S | 1/2016 | Kim et al. | |
| D747,371 | S | 1/2016 | Lee et al. | |
| D747,372 | S | 1/2016 | Kim et al. | |
| D747,373 | S | 1/2016 | Lee et al. | |
| D748,165 | S | 1/2016 | McConnell et al. | |
| 9,234,690 | B2 | 1/2016 | McCollugh et al. | |
| 9,250,010 | B2 | 2/2016 | De La Garza et al. | |
| 9,297,573 | B2 | 3/2016 | Krause et al. | |
| D754,759 | S | 4/2016 | McConnell et al. | |
| 9,320,368 | B2 | 4/2016 | Marotti et al. | |
| 9,328,955 | B2 | 5/2016 | Castro Solis et al. | |
| 9,339,993 | B2 | 5/2016 | Cites et al. | |
| D761,884 | S | 7/2016 | Austin et al. | |
| 9,448,007 | B2 * | 9/2016 | Tunzi | F25D 25/02 |
| 9,488,405 | B2 | 11/2016 | Lee et al. | |
| 9,500,403 | B2 | 11/2016 | Seo et al. | |
| 9,510,679 | B2 | 12/2016 | Bhatt et al. | |
| 9,671,115 | B2 | 6/2017 | Elkasevic | |
| 9,823,013 | B1 | 11/2017 | Caglin et al. | |
| 9,861,200 | B2 | 1/2018 | Lim | |
| 9,945,601 | B1 | 4/2018 | Bhavsar et al. | |
| 2003/0020387 | A1 | 1/2003 | Wing et al. | |
| 2004/0012314 | A1 | 1/2004 | Hay et al. | |
| 2004/0104323 | A1 | 6/2004 | Hubert et al. | |
| 2005/0073225 | A1 | 4/2005 | Kwon et al. | |
| 2006/0042305 | A1 | 3/2006 | Oh et al. | |
| 2006/0049731 | A1 | 3/2006 | Choi et al. | |
| 2006/0145577 | A1 | 7/2006 | Daley et al. | |
| 2006/0226749 | A1 | 10/2006 | Kim | |
| 2006/0226751 | A1 | 10/2006 | Park | |
| 2007/0126325 | A1 | 6/2007 | Gorz et al. | |
| 2008/0203041 | A1 | 8/2008 | Lim et al. | |
| 2008/0315743 | A1 | 12/2008 | Oh | |
| 2009/0193836 | A1 | 8/2009 | Ertz et al. | |
| 2010/0024464 | A1 | 2/2010 | Hwang et al. | |
| 2010/0102693 | A1 | 4/2010 | Driver et al. | |
| 2010/0109498 | A1 | 5/2010 | Ramm et al. | |
| 2010/0219731 | A1 | 9/2010 | Candeo et al. | |
| 2011/0001415 | A1 | 1/2011 | Park et al. | |
| 2011/0072846 | A1 | 3/2011 | Engel et al. | |
| 2011/0115356 | A1 | 5/2011 | Nash et al. | |
| 2012/0018434 | A1 | 1/2012 | Gwak | |
| 2012/0024006 | A1 | 2/2012 | Knoll et al. | |
| 2012/0091084 | A1 | 4/2012 | Amaral et al. | |
| 2012/0223038 | A1 | 9/2012 | Bean | |
| 2012/0248958 | A1 | 10/2012 | Ertz et al. | |
| 2013/0020922 | A1 | 1/2013 | Jang | |
| 2013/0219731 | A1 | 8/2013 | Zhang | |
| 2014/0217044 | A1 | 8/2014 | Cole | |
| 2015/0034668 | A1 | 2/2015 | Minard et al. | |
| 2015/0061484 | A1 | 3/2015 | Jeong et al. | |
| 2015/0068999 | A1 | 3/2015 | Dart et al. | |
| 2015/0107084 | A1 | 4/2015 | Craycraft et al. | |
| 2015/0168048 | A1 | 6/2015 | Sexton et al. | |
| 2015/0184929 | A1 | 7/2015 | Moon | |
| 2015/0351532 | A1 | 12/2015 | Peru | |
| 2016/0067863 | A1 | 3/2016 | Cole | |
| 2016/0290707 | A1 | 10/2016 | Burke et al. | |
| 2017/0086580 | A1 | 3/2017 | Conti | |
| 2017/0181538 | A1 | 6/2017 | Azkue et al. | |
| 2017/0276425 | A1 | 9/2017 | Fink et al. | |
| 2017/0328627 | A1 * | 11/2017 | Park | F25D 11/02 |
| 2017/0341217 | A1 | 11/2017 | Cole | |
| 2018/0127007 | A1 | 5/2018 | Kravchenko | |

FOREIGN PATENT DOCUMENTS

| | | | | |
|---|---|---|---|---|
| BR | 102015031731 | A2 | 6/2017 | |
| CN | 101611281 | A | 12/2009 | |
| CN | 201779952 | U | 3/2011 | |
| CN | 102135363 | A | 7/2011 | |
| CN | 102395849 | A | 3/2012 | |
| CN | 102494496 | A | 6/2012 | |
| CN | 202432813 | U | 9/2012 | |
| CN | 102829604 | A | 12/2012 | |
| CN | 102889744 | A | 1/2013 | |
| CN | 101688748 | B | 12/2013 | |
| CN | 104089457 | A | 10/2014 | |
| CN | 205619680 | U | 10/2016 | |
| CN | 205641793 | U | 10/2016 | |
| CN | 205980510 | U | 2/2017 | |
| DE | 8801508 | U1 | 6/1989 | |
| DE | 700820 | T1 | 11/1996 | |
| DE | 69519613 | T2 | 4/2001 | |
| DE | 10107646 | A1 | 8/2002 | |
| DE | 69529852 | T2 | 9/2003 | |
| DE | 102009045363 | A1 | 4/2011 | |
| DE | 102009054661 | A1 * | 6/2011 | F25D 23/04 |
| DE | 102013216974 | A1 | 4/2014 | |
| DE | 102012223131 | A1 | 6/2014 | |
| DE | 102015118946 | * | 5/2016 | F25D 23/04 |
| DE | 102014225089 | * | 6/2016 | F25D 23/04 |
| EP | 0577939 | A1 | 1/1994 | |
| EP | 700820 | A2 | 3/1996 | |
| EP | 579364 | B1 | 12/1997 | |
| EP | 940316 | A2 | 9/1999 | |
| EP | 1790250 | A2 | 5/2007 | |
| EP | 1349802 | B1 | 8/2008 | |
| EP | 1985205 | A1 | 10/2008 | |
| EP | 2072937 | A2 | 6/2009 | |
| EP | 2098810 | A2 | 9/2009 | |
| EP | 2354732 | A2 * | 8/2011 | F25D 23/04 |
| EP | 2424421 | B1 | 10/2015 | |
| EP | 2760315 | B1 | 8/2016 | |
| EP | 2926069 | B1 | 11/2016 | |
| EP | 3327390 | A1 | 5/2018 | |
| ES | 2327831 | T3 | 11/2009 | |
| IN | 201737009466 | | 8/2017 | |
| JP | H10115485 | A | 5/1998 | |
| JP | H10122733 | A | 5/1998 | |
| JP | H11237173 | A | 8/1999 | |
| JP | 2002090054 | A | 3/2002 | |
| KR | 100364994 | B1 | 12/2002 | |
| KR | 374557 | B1 | 3/2003 | |
| KR | 20030061668 | A | 7/2003 | |
| KR | 100431346 | B1 | 5/2004 | |
| KR | 1020040070986 | | 8/2004 | |
| KR | 20040095421 | A | 11/2004 | |
| KR | 100559722 | B1 | 3/2006 | |
| KR | 100756887 | B1 | 9/2007 | |
| KR | 850005 | B1 | 8/2008 | |
| KR | 2010026614 | A | 3/2010 | |
| KR | 20100023474 | A | 3/2010 | |
| KR | 20140022598 | A | 2/2014 | |
| KR | 2017043815 | A | 4/2017 | |
| WO | 02014761 | A1 | 2/2002 | |
| WO | 2004104504 | A1 | 12/2004 | |
| WO | 2005003660 | A1 | 1/2005 | |
| WO | 2005012812 | A1 | 2/2005 | |
| WO | 2007128734 | A1 | 11/2007 | |
| WO | 2008015180 | A2 | 2/2008 | |
| WO | 2009155679 | A2 | 12/2009 | |
| WO | 2011009773 | A2 | 1/2011 | |
| WO | WO-2011057957 | A2 * | 5/2011 | F25D 23/04 |
| WO | 2011080109 | A2 | 7/2011 | |
| WO | 2012025382 | A2 | 3/2012 | |
| WO | 2012062670 | A2 | 5/2012 | |
| WO | WO-2012130578 | A1 * | 10/2012 | F25D 23/028 |
| WO | 2013126515 | A1 | 8/2013 | |
| WO | 2015101430 | A1 | 7/2015 | |
| WO | 2015101434 | A1 | 7/2015 | |
| WO | 2015149832 | A1 | 10/2015 | |
| WO | 2015165531 | A1 | 11/2015 | |
| WO | 2016155784 | A1 | 10/2016 | |
| WO | 2017005314 | A1 | 1/2017 | |

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.

(56) References Cited

OTHER PUBLICATIONS

GE Appliances, GE Profile Side by Side Refrigerators, Jan. 17, 2014, http://www.abt.com/ge/GE_Profile_SideBySide.

* cited by examiner

REFRIGERATOR SHELF TRANSLATION SYSTEM

CROSS-REFERENCE TO RELATED APPLICATION

This application claims priority to Brazilian Patent Application No. BR102017019233.4, filed Sep. 8, 2017, entitled "Refrigerator Shelf Translation System," the disclosure of which is hereby incorporated herein by reference in its entirety.

FIELD OF THE DEVICE

The present device relates to a shelf translation system, preferably arranged in the door of a refrigerator. The system is basically integrated by shifting, which allows the easy vertical displacement and locking of a movable shelf in relation to a fixed reference frame.

BACKGROUND OF THE DEVICE

As it is well known in the state of the art, domestic refrigerators are provided with several compartments which are intended to store, in an organized manner, products in their inside. Among these compartments, it is possible to mention the shelves arranged in the doors, which, in large part, aim to receive products of small and medium size that are arranged there, with easy access to the user. In the same sense, it is also known from the prior art that shelves can be disengaged from the doors, thus allowing them to be moved to another position or location, inside and outside the refrigerator.

An example of a movable shelf can be seen in patent document P103026043. According to the embodiment described therein, there is provided an inner panel against which shelves are removably fastened so that they can be vertically and selectively displaced between a lowered position and a raised position.

Another example of solution related to this technology can be found in document P10032036. According to the embodiment described in this document, shelves with height adjustment possibility are provided without the need to remove them from the refrigerator door, whereby pins and rails are provided for their movement since they generate stopping and locking points.

The prior art documents, however, fail to provide solutions capable of facilitating the shelf movement. Consequently, the solutions belonging to the current state of the art end up compelling the user to remove the products stored therein to decouple them from the refrigerator and thus subsequently move them.

SUMMARY OF THE DEVICE

Therefore, the present device aims, basically, to solve the problem of vertical movement of shelves applied to the refrigerator door.

It is also another object of the present device to provide a translation system that allows the movement of the shelf without it being uncoupled from the refrigerator door.

Another object of the present device is to provide a translation system which allows the anchoring of the shelf at several anchorage points.

All objects of the device in question are achieved by way of the shelf translation system, which includes at least one movable shelf, at least one guide structure provided with one or more indentations that can be vertically-spaced from each other, the movable shelf being able to be vertically moved relative to the guide structure.

According to the device in question, the refrigerator shelf translation system further includes at least one anchoring component, which is fixedly associated with the movable shelf and suitably associated with the guide structure.

The anchoring component includes at least one coupling interface for fastening the anchoring component in the movable shelf, at least one guide interface for displacement orientation relative to the guide structure, and at least one locking span cooperating with at least one of the indentations of the guide structure. The anchoring component further including at least one resilient appendage associated with the at least one anchoring component.

In general terms, the movable shelf is held in a fixed position relative to the guide structure when there is cooperation between at least one locking span of at least one anchoring component and at least one indentation of the guide structure and, on the other hand, the movable shelf may be shifted vertically relative to the guide structure when all possible locking spans move away from all possible anchoring components and their respective indentations of the guide structure.

From a functional point of view, the distancing of all possible locking positions from all possible anchoring components and their respective indentations of the guide structure is initiated, stimulated, and/or generated by the application of a force (directed to the inner wall of the refrigerator) on the movable shelf and, the resilient appendage re-establishes cooperation between at least one locking span of at least one anchoring component and at least one indentation of the guide structure.

These and other features, advantages, and objects of the present device will be further understood and appreciated by those skilled in the art upon studying the following specification, claims, and appended drawings.

BRIEF DESCRIPTION OF THE DRAWINGS

The preferred embodiment of the subject device is described in detail based on the listed figures, which are of a purely exemplary and non-limiting nature, since adaptations and modifications may be made without thereby departing from the scope of the claimed protection.

DETAILED DESCRIPTION OF THE DEVICE

Figure 1:
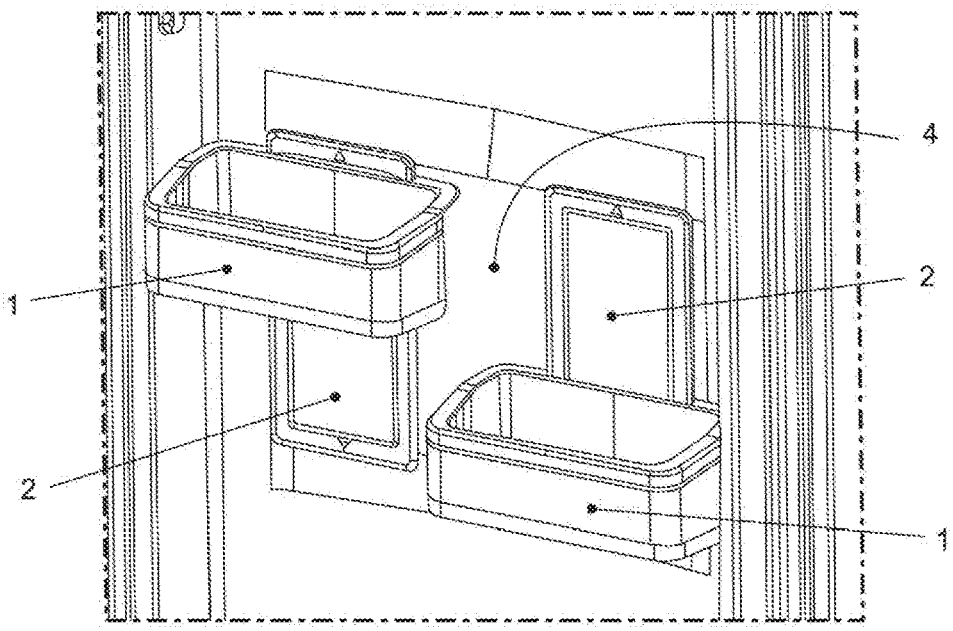
FIG. 1 shows, in front perspective, the shelf translation system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
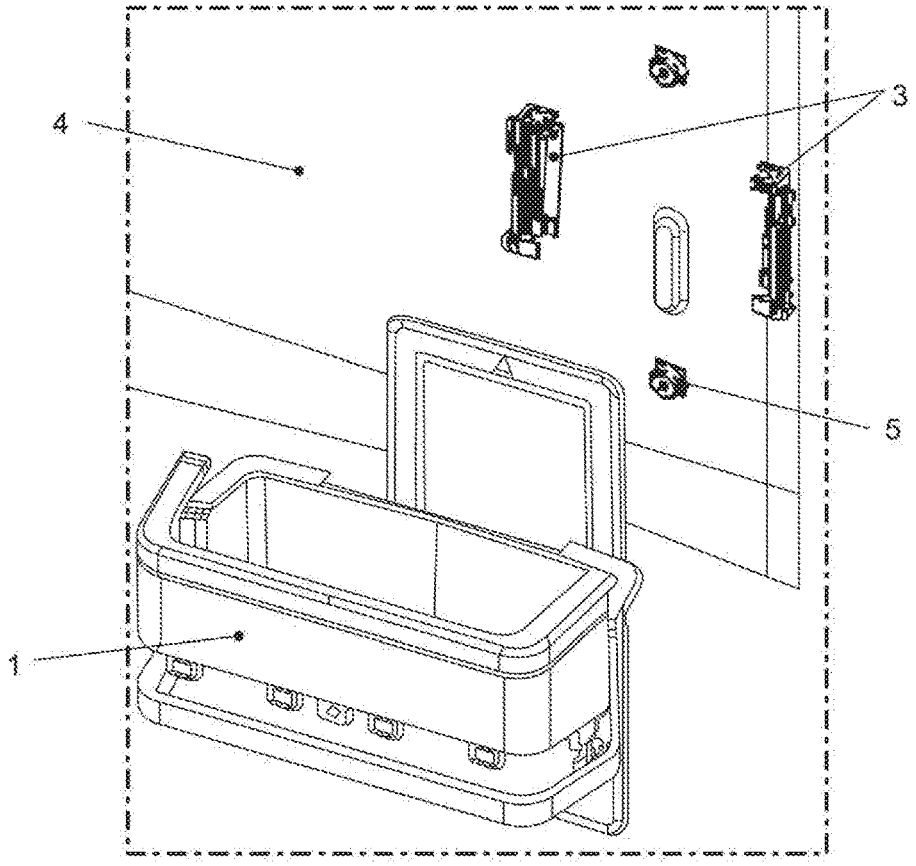
FIG. 2 shows, in exploded front perspective, the shelf translation system.

As shown in FIGS. 1 and 2, the shelf translation system, object of the device in question, essentially includes a movable shelf 1, a guide structure 2 and two anchoring components 3.

Preferably, the guide structure 2 is fastened to one of the inner walls 4 of the refrigerator. Particularly, the guide structure 2 is fastened to the inner wall 4 of the refrigerator door.

According to the device in question, the anchoring components 3 enable temporary fixing of the movable shelf 1 on the guide structure 2. Accordingly, the attachment between the movable shelf 1 and the guiding structure 2 occurs indirectly, always by way of the anchoring components 3.

Figure 3:
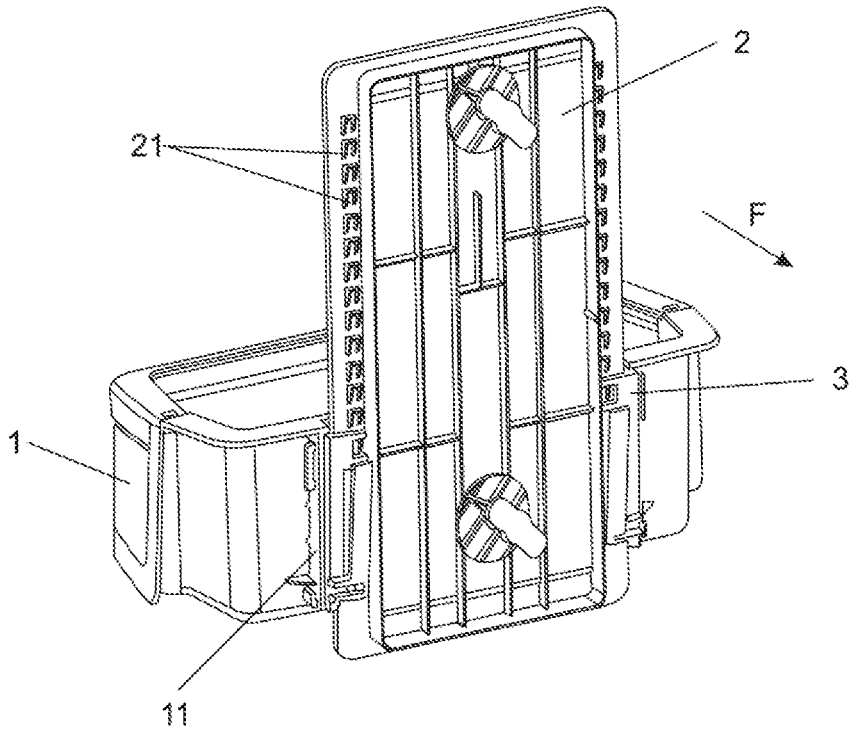
FIG. 3 shows, in front perspective, the shelf translation system.

In general, the movable shelf 1 includes a body that includes an engaging means 11 on a rear region that allow the coupling of the anchoring components 3. As shown in FIG. 3, a movable shelf 1 has two engaging means 11, each being defined by a groove that enables the attachment of an engaging means 11. The engaging means 11 could include alternate, such as, for example, holes capable of accommodating screws or pins projected from the anchoring components 3.

Generally, the guide structure 2, which is fastened to one of the inner walls 4 of the refrigerator by way of a fastening component 5 (e.g., a coupling sleeve) includes a plurality of indentations 21 that are spaced apart in a vertical direction. Preferably, the indentations 21 are disposed on the rear face of the guide structure 2, and more particularly, in the lateral regions of the rear face of the guide structure 2. This preferred embodiment is particularly advantageous in that, in this way, the indentations 21 are not visible to the users, in addition, the front face of the guide structure 2 can be smooth and/or used decoratively.

Figure 5:
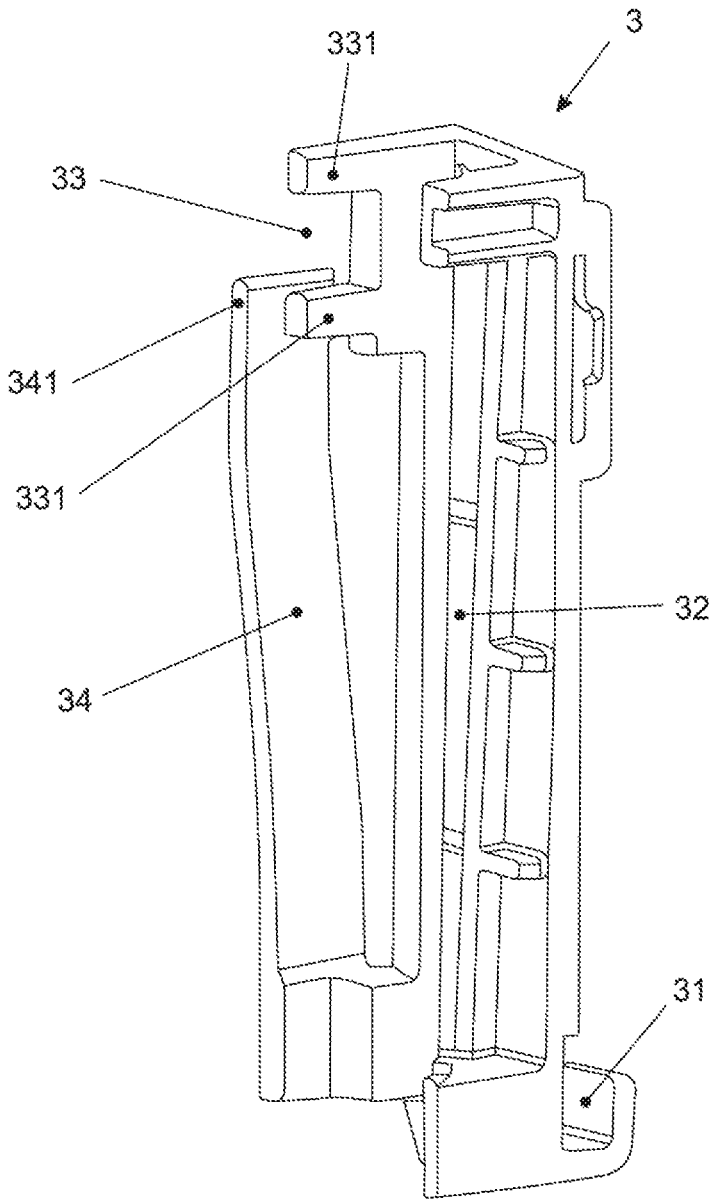
FIG. 5 shows, in magnified detail, the anchoring component that integrates the shelf translation system.

Still more generally, as shown in FIG. 5, each anchoring component 3 includes a coupling interface 31, a guide interface 32, a locking span 33 and a resilient appendage 34.

The coupling interface 31 has the purpose of enabling the fastening, even if temporary, between the movable shelf 1 and the anchoring component 3 itself. In the preferred embodiment of the subject device, the coupling interface 31 is a channel capable of cooperating with the rib defining the engaging components 11 of the movable shelf 1.

The guide interface 32 aims to guide the vertical displacement of the anchoring component 3 (and consequently the displacement of the movable shelf 1) relative to the guide structure 2. In the preferred embodiment of the device, the guide interface 32 includes a longitudinal channel that can be coupled to the side of the guide structure 2.

The locking span 33 is intended to cooperate with one of the multiple indentations 21 of the guiding structure 2. In the preferred embodiment of the device, the locking span 33 includes the space defined between two projections 331.

The resilient appendage 34 is a vertical projection existing from one of the longitudinal ends of the anchoring component 3. Accordingly, the resilient appendage 34 has only one free end 341 since its other end is amalgamated to one of the ends of the anchoring component 3. Preferably, as shown in FIG. 5, the free end 341 of the resilient appendage 34 is aligned with the locking span 33.

Figure 4:
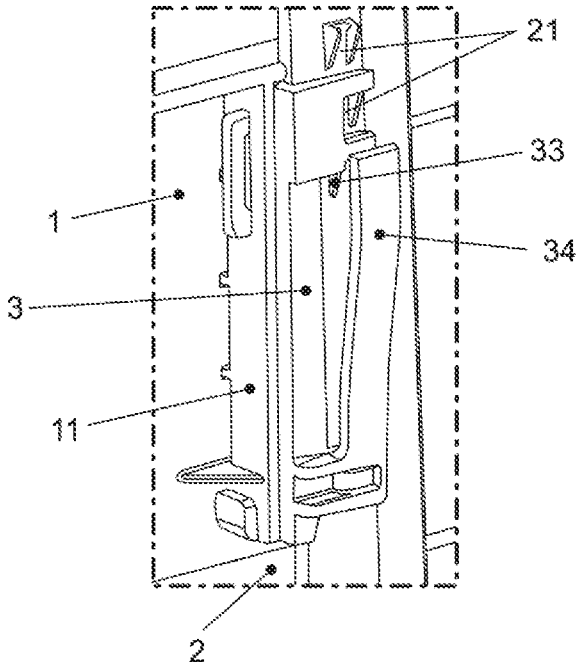
FIG. 4 shows, in magnified detail, the physical interaction of certain components of the shelf translation system.

Since the main constructional details of the elements integrating the translation system for the shelf have been sufficiently described and shown, it remains to be noted the mode of operation of the device in question, and for that, particular reference is made to FIGS. 3 and 4.

As shown in these figures, it is noted that the movable shelf assembly 1 and anchoring components 3 are able to remain in a static position, relative to the guide structure 2, when the locking spans 33 of the anchoring components 3 cooperate with respective indentations 21 of the guide structure 2.

This situation may even be referred to as a "coupled" situation, after all, it is preferred that in a situation of reset (situations in which no user-caused interference occurs) the movable shelf 1 is always anchored at a fixed point of the guide structure 2, wherein the anchoring, as set forth above, is a function of the cooperation between the locking spans 22 and the indentations 21.

Once the user applies force F (force towards the inner wall 4 of the refrigerator) to the movable shelf assembly 1 and anchoring components 3, the locking spans 33 and the indentations 21 cease to cooperate with each other. In the end, the entire movable shelf assembly 1 and the anchoring components 3 advance towards the inner wall 4 of the refrigerator, ceasing the physical contact between the locking spans 33 and the indentations 21. This situation can also be called a "decoupled" situation.

Since the cooperation between the locking spans 33 and the indentations 21 is interrupted, the movable shelf assembly 1 and the anchoring components 3 may be vertically moved along the length of the guide structure 2, as the user's wishes. Once the desired new position is reached, it is sufficient for the user to stop the application of the force F such that the cooperation between the locking spans 33 and the indentations 21 resumes.

Such automatic return, so to speak, occurs as a function of the resilient appendage 34, after which, when in a "decoupled" situation, the free end 341 of the resilient appendage 34 is pressed against the inner wall 4 of the refrigerator, being temporarily deformed for the duration of the application of the force F. Once the force F is interrupted, the free end 341 of the resilient appendage 34, which has accumulated potential energy, ultimately pushes the entire movable shelf assembly 1 and anchoring components 3 in the direction opposite the force F, that is, it ends up pushing the entire movable shelf assembly 1 and anchoring components 3 forward, causing the locking spans 33 to cooperate again with the indentations 21.

In this way, it is observed that all the objects of the device are achieved; indeed, it is proposed a practical and simplified way allowing the vertical movement of a shelf relative to a fixed referenced frame. In this sense, one can point out that the great merits of the device in question lies in the form of cooperation between the components of the system and, in addition, in the very simplified embodiment of the components of the system.

Lastly, it is also important to stress that the foregoing description has the sole objective of exemplarily describing the preferred embodiment of the device in question. Therefore, it is clear that the modifications, the variations and the constructive combinations of elements performing the same function in substantially the same way in order to achieve the same results still fall under the scope of protection delimited by the claims.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator shelf translation system comprising:

at least one movable shelf;

at least one guide structure provided with one or more indentations, wherein the at least one guide structure is fastened to an inner wall of a refrigerator;

the at least one movable shelf being vertically actuatable relative to the at least one guide structure;

at least one anchoring component associated with the at least one movable shelf and movably associated with the at least one guide structure;

the at least one anchoring component comprising a coupling interface for fastening the at least one anchoring component to the at least one movable shelf, a guide interface for guiding displacement of the at least one anchoring component relative to the at least one guide structure, a locking span for cooperating with at least one of the one or more indentations of the at least one guide structure, and a resilient appendage having a free end that is proximate to, and aligned with, the locking span, wherein the free end of the resilient appendage directly contacts the inner wall of the refrigerator to which the at least one guide structure is fastened, wherein the locking span is defined by two projections, and wherein upon application of a force to the at least one movable shelf in a direction toward the inner wall of the refrigerator, a distance between the free end and the two projections is decreased;

the at least one movable shelf being held in a fixed position relative to the at least one guide structure when cooperation exists between the at least one anchoring component and at least one of the one or more indentations of the at least one guide structure; and the at least one movable shelf being movable vertically relative to the at least one guide structure when the locking span of the at least one anchoring component is disengaged from the one or more indentations of the at least one guide structure.

2. The refrigerator shelf translation system of claim 1, wherein a distancing of the locking span of the at least one anchoring component from the one or more indentations of the at least one guide structure is generated by the force applied to the at least one movable shelf towards the inner wall of the refrigerator.

3. The refrigerator shelf translation system of claim 1, wherein upon release of the force, the resilient appendage restores cooperation between the locking span of the at least one anchoring component and at least one of the one or more indentations of the at least one guide structure.

4. The refrigerator shelf translation system of claim 1, wherein the at least one movable shelf further comprises: an engaging component on a rear region thereof that is configured to be received within the coupling interface of the at least one anchoring component.

5. The refrigerator shelf translation system of claim 4, wherein the engaging component is defined as a rib that is received within a channel of the coupling interface.

6. The refrigerator shelf translation system of claim 1, wherein upon application of the force toward the inner wall of the refrigerator, an entirety of the at least one movable shelf and an entirety of the at least one anchoring component advance toward the inner wall of the refrigerator.

7. A refrigerator shelf translation system comprising:

at least one movable shelf;

at least one guide structure provided with one or more indentations, wherein the at least one guide structure is fastened to an inner wall of a refrigerator;

the at least one movable shelf being vertically actuatable relative to the at least one guide structure;

at least one anchoring component fixedly associated with the at least one movable shelf and movably associated with the at least one guide structure;

the at least one anchoring component comprising a coupling interface for fastening the at least one anchoring component to the at least one movable shelf, a guide interface for guiding displacement of the at least one anchoring component relative to the at least one guide structure, a locking span for cooperating with at least one of the one or more indentations of the at least one guide structure, and a resilient appendage having a free end that is proximate to, and aligned with, the locking span, wherein the free end of the resilient appendage directly contacts the inner wall of the refrigerator to which the at least one guide structure is fastened, wherein the locking span is defined by two projections, and wherein upon application of a force to the at least one movable shelf in a direction toward the inner wall of the refrigerator, a distance between the free end and the two projections is decreased; and the at least one movable shelf being movable vertically relative to the at least one guide structure when the locking span of the at least one anchoring component is disengaged from the one or more indentations of the at least one guide structure.

8. A refrigerator shelf translation system comprising:

a movable shelf;

a guide structure provided with one or more indentations, wherein the guide structure is fastened to an inner wall of a refrigerator;

the movable shelf being vertically actuatable relative to the guide structure; and an anchoring component associated with the movable shelf and movably associated with the guide structure, the anchoring component comprising:

a locking span defined by two projections, wherein the locking span cooperates with at least one of the one or more indentations of the guide structure to fix the movable shelf at a desired position relative to the guide structure; and a resilient appendage having a free end that is proximate to the locking span, wherein the free end of the resilient appendage directly contacts the inner wall of the refrigerator to which the guide structure is fastened, wherein upon application of a force to the movable shelf in a direction toward the inner wall of the refrigerator, a distance between the free end and the two projections is decreased and the movable shelf can move relative to the guide structure.

9. The refrigerator shelf translation system of claim 8, wherein the anchoring component comprises: a coupling interface for fastening the anchoring component to the movable shelf; and a guide interface for guiding displacement of the anchoring component relative to the guide structure.

10. The refrigerator shelf translation system of claim 9, wherein the movable shelf further comprises: an engaging component on a rear region thereof that is configured to be received within the coupling interface of the anchoring component.

11. The refrigerator shelf translation system of claim 10, wherein the engaging component is defined as a rib that is received within a channel of the coupling interface.

12. The refrigerator shelf translation system of claim 8, wherein the movable shelf is held in a fixed position relative to the guide structure when cooperation exists between of the anchoring component and at least one of the one or more indentations of the guide structure.

13. The refrigerator shelf translation system of claim 8, wherein the movable shelf is movable vertically relative to the guide structure when the locking span of the anchoring component is disengaged from the one or more indentations of the guide structure.

14. The refrigerator shelf translation system of claim 8, wherein a distancing of the locking span of the anchoring component from the one or more indentations of the guide structure is initiated by the application of the force to the movable shelf towards the inner wall of the refrigerator.

15. The refrigerator shelf translation system of claim 8, wherein upon release of the force, the resilient appendage restores cooperation between the locking span of the anchoring component and at least one of the one or more indentations of the guide structure.

16. The refrigerator shelf translation system of claim 8, wherein the free end is aligned with the locking span.

17. The refrigerator shelf translation system of claim 8, wherein upon application of the force toward the inner wall of the refrigerator, an entirety of the movable shelf advances toward the inner wall of the refrigerator.

18. The refrigerator shelf translation system of claim 8, wherein upon application of the force toward the inner wall of the refrigerator, an entirety of the anchoring component advances toward the inner wall of the refrigerator.

* * * * *